US005485980A

United States Patent [19]

Luccia

[11] Patent Number: 5,485,980

[45] Date of Patent: Jan. 23, 1996

[54] INVERTED BOOK STAND

[76] Inventor: Paul Luccia, 427 W. County Line Rd., Huntingdon Valley, Pa. 19006

[21] Appl. No.: 345,313

[22] Filed: Nov. 28, 1994

[51] Int. Cl.[6] ..... A47B 23/00

[52] U.S. Cl. ..... 248/445; 248/444.1; 248/460

[58] Field of Search ..... 248/445, 452, 248/447.2, 444.1, 441.1, 451, 452, 459, 460

[56] References Cited

U.S. PATENT DOCUMENTS

| | | | |
|---|---|---|---|
| D. 220,911 | 6/1971 | McGrady | 33/3 |
| 1,671,231 | 5/1928 | Culbertson . | |
| 2,333,353 | 11/1943 | Zanella | 248/452 |
| 2,337,675 | 12/1943 | McNeil | 45/60 |
| 2,546,283 | 5/1951 | Webster | 311/28 |
| 2,741,869 | 4/1956 | Aibel | 45/82 |
| 2,823,489 | 2/1958 | Laing | 45/82 |
| 2,908,465 | 10/1959 | Lykes | 248/445 |
| 3,128,573 | 4/1964 | Johnson | 248/445 |
| 3,476,348 | 11/1969 | Rustad | 248/445 X |
| 3,664,629 | 5/1972 | Reed | 248/445 |
| 3,740,015 | 6/1973 | Adams | 248/445 |
| 3,894,709 | 7/1975 | Weir | 248/445 |
| 4,313,589 | 2/1982 | Vega | 248/444.1 X |
| 4,378,102 | 5/1983 | Portis, Jr. et al. | 248/460 |
| 4,431,156 | 2/1984 | Mena | 248/445 |
| 4,718,630 | 1/1988 | Richard | 248/444.1 |
| 4,867,407 | 9/1989 | Becker | 248/447.2 X |
| 4,925,144 | 5/1990 | White | 248/445 |
| 5,129,616 | 7/1992 | Carson | 248/457 |

FOREIGN PATENT DOCUMENTS

| | | | |
|---|---|---|---|
| 1518012 | 3/1968 | France | 248/441.1 |
| 1478012 | 6/1977 | United Kingdom . | |

*Primary Examiner*—J. Franklin Foss
*Attorney, Agent, or Firm*—Volpe and Koenig

[57] ABSTRACT

An inverted book stand having a book support platform comprised of two pivotally connected, transparent panels. The panels can be moved from a first, stowed position, where the panels are folded together and in close proximity to each other, to a second, in use position, where the panels are folded open to an angle of less than 180° to form the support platform. The panels are formed with an integral, angle limiting feature at the pivotal connection to maintain the angle between panels when they are in the open position. Support members are pivotally connected to the outer edge of each panel, opposite to edge of the panel from where the panels are connected to each other. The support members can be moved from a first, stowed position, wherein each support member is in a closed position parallel and adjacent to its respective panel, and a second, in use position, where the support member is pivoted to an angle of more than 90° from the panel surface. An integral limiting feature is provided at the pivotal connection between the support members and the panels to limit the angle formed between them when the support members are opened. The book stand can be folded to a substantially flat configuration for transport.

10 Claims, 4 Drawing Sheets

INVERTED BOOK STAND

FIELD OF THE INVENTION

This invention relates to an inverted book stand. In particular, the invention relates to a light-weight, portable stand which holds a book to be read by one in a supine position. The book stand can be folded flat for transport and is especially useful in outdoor environments.

BACKGROUND OF THE INVENTION

Reading in a supine position has presented problems, regardless of whether the reader is indoors or outdoors. For example, holding the book above one's head quickly causes the reader's arms to grow tired. Extension of the arms above one's body causes even the lightest of reading materials to feel heavy and cumbersome to handle. These problems are accelerated when the reader is outdoors. Wind and varying angles of sunlight can make manipulation of the book even more difficult. These problems are further accelerated in the event the reader begins to sleep while reading, as often occurs in the relaxed setting of a beach or other waterfront.

The prior art has attempted to address these problems with stands to support books in the proper position for supine reading. However, these stands have introduced new and additional problems to reading outdoors. For example, many known stands simply lack the portability required to easily move the stand from storage to the outdoor reading environment. Although some prior stands are light weight, they are not designed for easy transport. Further, the prior stands either made page manipulation very difficult or fail to provide means for preventing the book's pages from being moved in a breezy outdoor environment. The stability of the book stand itself is also a problem in the breezy environments encountered at a beach or waterfront.

U.S. Pat. No. 2,741,869 to Aibel (Apr. 17, 1956) teaches a reading stand wherein a transparent book holder portion is supported in a rack having supporting legs. Aibel discloses sharpening the legs so they can be forced into the ground when using the stand in an outdoor environment. However, this stand is relatively large and bulky, even in a folded state.

U.S. Pat. No. 2,823,489 to Laing (Feb. 18, 1958) discloses a reading stand having an angled platform to support the book. The angled platform is composed of two flat panels connected by a hinge and having a separate angle control member to prevent over-extension of the hinge. However, Laing discloses no means for controlling the pages of the book or the stand itself in a windy environment. Moreover, the Laing stand is not portable for easy transport.

U.S. Pat. No. 4,925,144 to White (May 15, 1990) discloses a book holder on a single support leg. The single leg is inserted into the ground during use. However, this arrangement lacks the stability needed for outdoor wind conditions and makes repositioning for sun blocking more tedious due to the use of a single leg.

SUMMARY OF THE INVENTION

The present invention is an inverted book stand for outdoor use. The book stand is comprised of a book support platform having two, pivotally connected, transparent panels. The panels can be moved from a first, stowed position, where the panels are folded together and in close proximity to each other, to a second, in use position, where the panels are folded open to an angle of less than 180° to form the support platform. Integral limiting means are provided on the panels at the pivotal connection to maintain the angle between panels when they are in the open position.

Support members are pivotally connected to the outer edge of each panel, opposite to edge of the panel from where the panels are connected to each other. The support members can be moved from a first, stowed position, wherein each support member is in a closed position parallel and adjacent to its respective panel, and a second, in use position, where the support member is pivoted to an angle of more than 90° from the panel surface. Integral limiting means are provided at the pivotal connection between the support members and the panels to limit the angle formed between them when the support members are opened. The book stand can be folded to a flat, compact size by folding the panels and the support members to the stowed positions.

Page retaining means are provided on the support platform. The page retainers keep the book on the stand during reading and prevent the windy, outdoor environment from moving the pages of the book and/or the book itself.

It is to be understood that the word "book", as used hereinafter, includes any type of reading materials. For example, "book", whether presented in singular or plural fashion, includes, but is not limited to, books, magazines, newspapers, pamphlets, and the like.

It is an object of the current invention to provide an inverted book stand for holding books above the head of a reader in the supine position.

It is an object of the invention to provide an inverted book stand which can be folded flat for easy hand carrying.

It is an object of the invention to provide an inverted book stand capable of being used outdoors.

These and other objects of the invention will become apparent upon consideration of the description, drawings and claims.

DETAILED DESCRIPTION OF A PREFERRED EMBODIMENT

Figure 1:
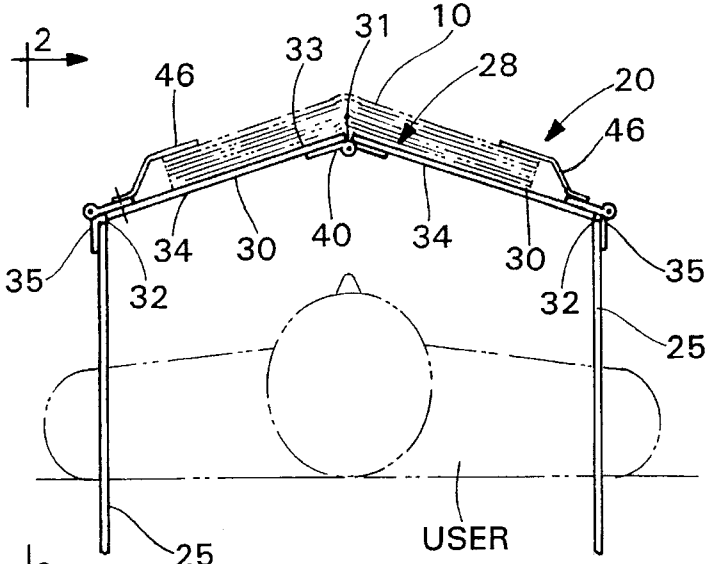
FIG. 1 is a front view of the book stand of the present invention in use.
Figure 2:
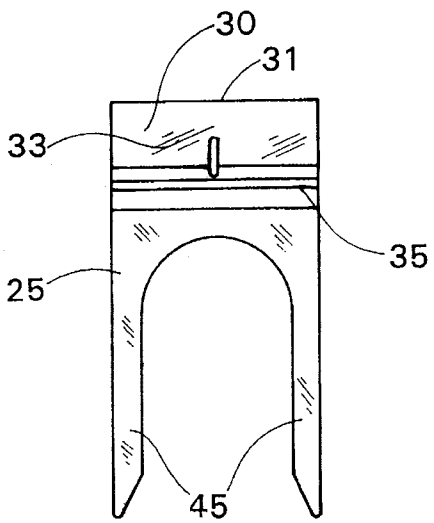
FIG. 2 is a side view of the book stand of the present invention in use.

Referring now to FIGS. 1 and 2, the inverted book stand 20 of the present invention is shown. The book stand 20 is comprised of a support platform 28 and support members 25. The support platform 28 is formed from two transparent panels 30. The panels 30 are generally planar, each having an inner edge 31, and an outer edge 32, a book supporting surface 33, which faces upward in the vertical direction during use, and a viewing surface 34, facing downward. The panels 30 are pivotally connected along the inner edges 31.

Support members 25 are pivotally connected to the panels 30 along the outer edges 32. During use, book 10 rests on the book supporting surface 33. The user reads book 10 through the transparent material as viewed from viewing surface 34.

Figure 3:
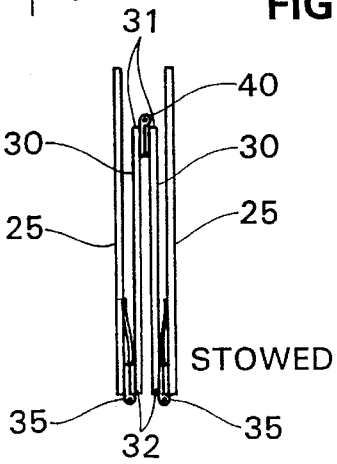
FIG. 3 is a front view of the book stand of the present invention when folded for transport.

The panels 30 are pivotally connected to each other along the inner edges 31 by a center hinge 40 such that the panels 30 can be moved from a first, stowed position, as shown in FIG. 3, where the panels 30 are folded together and in close proximity to each other, to a second, in use position, as shown in FIG. 1, where the panels 30 are folded open to an angle of less than 180° to form the support platform 28. Integral limiting means are provided to restrict the angle that can be formed between the surfaces of the panels 30 to maintain the panels 30 in a peaked configuration during use.

Figure 4:
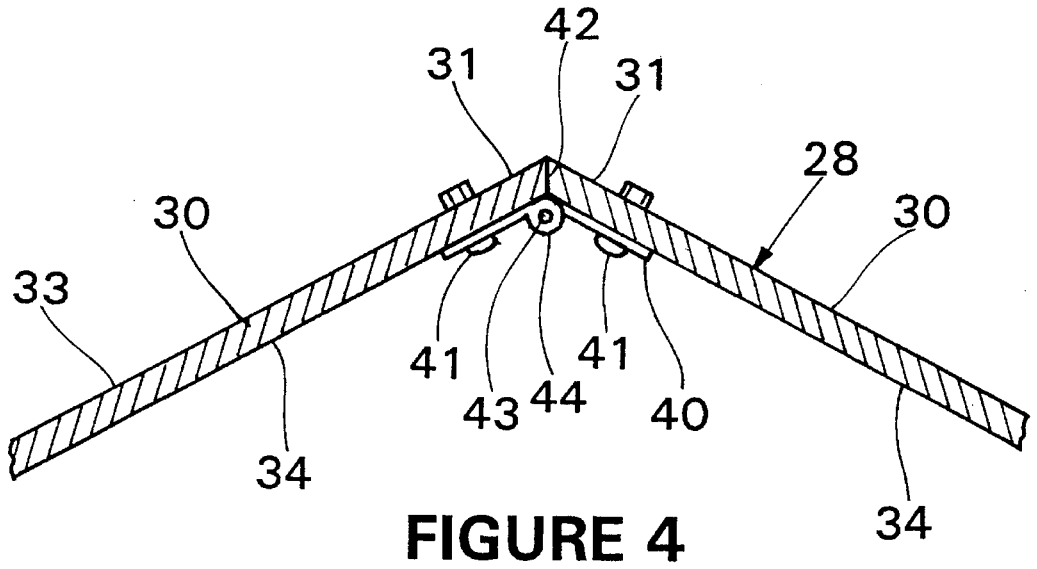
FIG. 4 is an enlarged view of the pivotal connection between the upper panels of the invention.

The pivotal connection with the integral limiting means of the preferred embodiment of the invention is shown in detail in FIG. 4. Each hinge half of the center hinge 40 is connected to the viewing side 34 of a respective panel 30 along the inner edge 31 by conventional mounts 41, such as rivets, screws, or the like. The portions of hinge 41 are joined by pin 43 inserted through the aligned apertures 44 in each hinge halve.

Although the preferred connector is a hinge 40, the panels 30 may be alternatively connected with a clear, flexible plastic material bonded to the panel surface along the edges Alternatively, the support platform 28 is of unitary construction, and the pivotal connection comprises a weakened point allowing flexion between the two panels 30.

Returning to FIG. 1, support platform 28 is in a peaked configuration during use, The angle measured between the upper panels 30 is generally an obtuse angle less than 180°. Preferably this angle measures in the range of 140°–150°. The angle between panels 30 is maintained when stand 20 is in use by integral limiting means. In the preferred embodiment, the integral limiting means is comprised of a beveled surface 42 along the inner edge of each panel 30. When the panels 30 are in the open, in use position, the beveled surfaces 42 contact each other to limit the open angle between the panels 30 to the preferred range. Alternatively, the hinge 40 may be a self-limiting hinge which has a maximum opening angle that falls in the preferred range.

The support members 25 are pivotally connected to the panels 30 by side hinges 35 such that the support members can be moved from a first, stowed position, wherein each support member is in a closed position parallel and adjacent to a respective panel 30, as shown in FIG. 3, and a second, in use position, where the support member is pivoted to an angle of more than 90° from the panel surface. Integral limiting means are provided to restrict the angle that can be formed between a support member 25 and a respective panel 30 to maintain the stability of the book stand during use.

Figure 5:
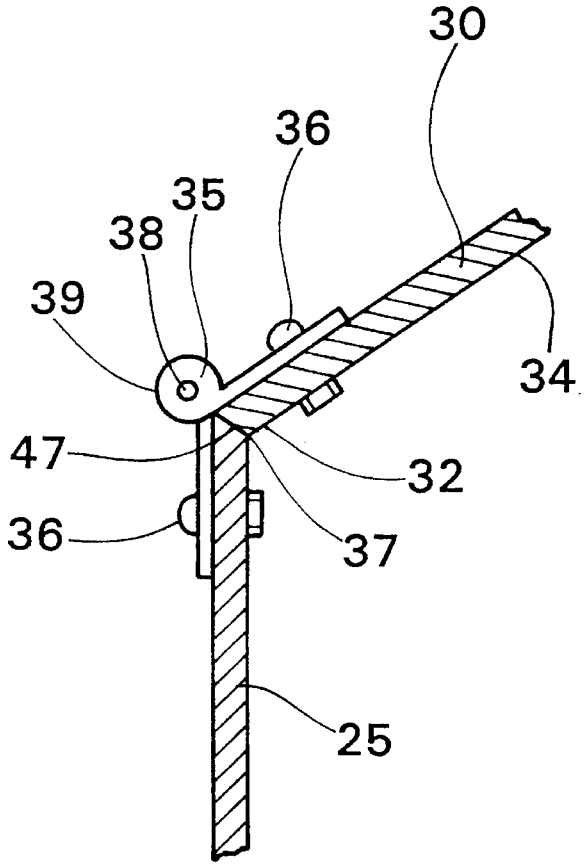
FIG. 5 is an enlarged view of the pivotal connection between a side member ant an upper of the invention.

Referring to FIG. 5, the connection between the support member 25 and the panel 30 is shown in detail. The side hinges 35 function in a similar manner to the center hinge 40. Hinge halves are attached to the outer edge 32 of each panel 30 on the book supporting side 33 and to the support members 25. Attachment means, such as rivets 36, are used to connect the hinge halves to the panels 30 and the support members 25. A pin 38 is inserted through the aligned apertures 39 in the hinge halves to pivotally connect the panels 30 with a respective support member 25.

Integral limiting means which restrict the opening angle between the support members 25 and the respective panels function in a similar manner to the center panel limiting means. Generally, the support members are opened to an angle in the range of 105°–110°. In the preferred embodiment, this is accomplished by providing a beveled surface 47 along the top edge of the support member 25 which contacts a beveled surface 37 along the outside edge 32 of the panel 30 to limit the open angle between the panel 30 and the support member 25 to the preferred range.

In the preferred embodiment, sand spikes 45 are formed from the bottom of the support members 25. In use, the sand spikes 45 are inserted into the ground to prevent movement of stand 20 during reading in windy, outdoor environments.

Preferably, the panels 30 and the support members 25 are made of a transparent substance such as Lucite®, Lexan®, or plexiglass.

In the preferred embodiment, page retainers 46 are mounted on the book holding surface 33 of upper panel 30. The page retainers are comprised of a flexible wire 48 which is pivotally attached by a fastener 49 along the outer hinge 35. The page retainers 46 prevent book 10 from being disturbed while read in the outdoor environment. At least one page retainer 46 is mounted to each panel 30. However, a plurality of page retainers may be mounted on each panel 30 to provide greater support for book 10.

Figure 6:
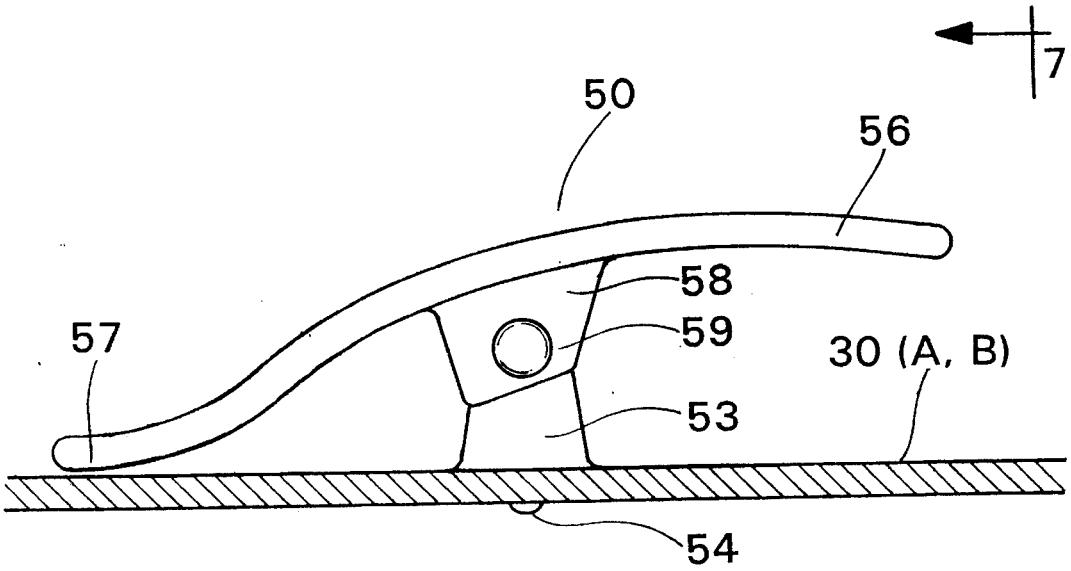
FIG. 6 is a front view of a page retainer of an alternative embodiment of the invention.
Figure 7:
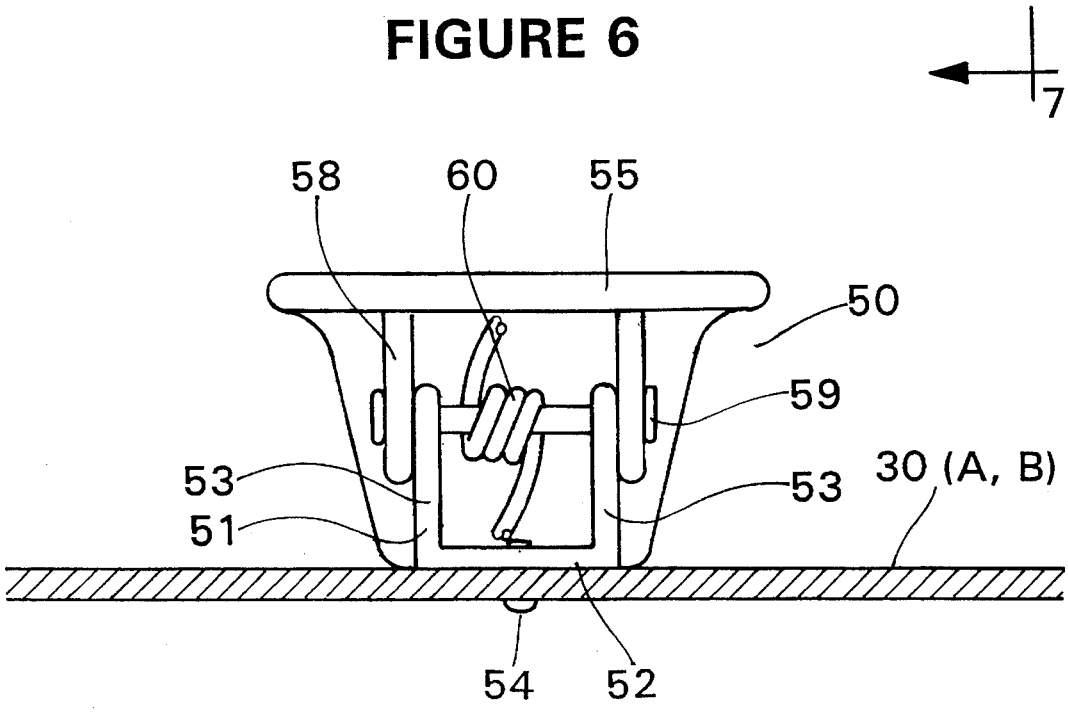
FIG. 7 is a view along line 7—7 in FIG. 6.

FIGS. 6 and 7 provide a detailed view of an alternative embodiment of a page retainer 50. In the alternative embodiment, the page retainer 50 is a spring tension device mounted directly to reading surface 33 with fastener 54. The page retainer 50 can rotate about fastener 54 The page retainer 50 comprises a base 51, having a base platform 52, which is attached directly to book holding surface 33 of upper panel 30. Extending upward from base platform 52 are vertical extensions 53. Retainer handle 55 includes vertically descending lower platform connectors 58 which connect the retainer handle 55 to the base 51. Platform connector 58 serves to connect retainer handle 55 with page retainer base 51 by means of connecting axle 59.

Retainer handle 55 comprises a control portion 56 and a gripping section 57. In use, the reader presses control portion 56 to pivot retainer handle 55 about pin 59 to raise gripping section 57. This action allows insertion of book pages thereunder. Gripping section 57 holds book 10 on book holding surface 33 by means of tension supplied by tension provider 60. Preferably, tension provider 60 is a spring-like mechanism which returns gripping portion 57 towards book holding surface 33 upon release of control portion 56.

Figure 8:
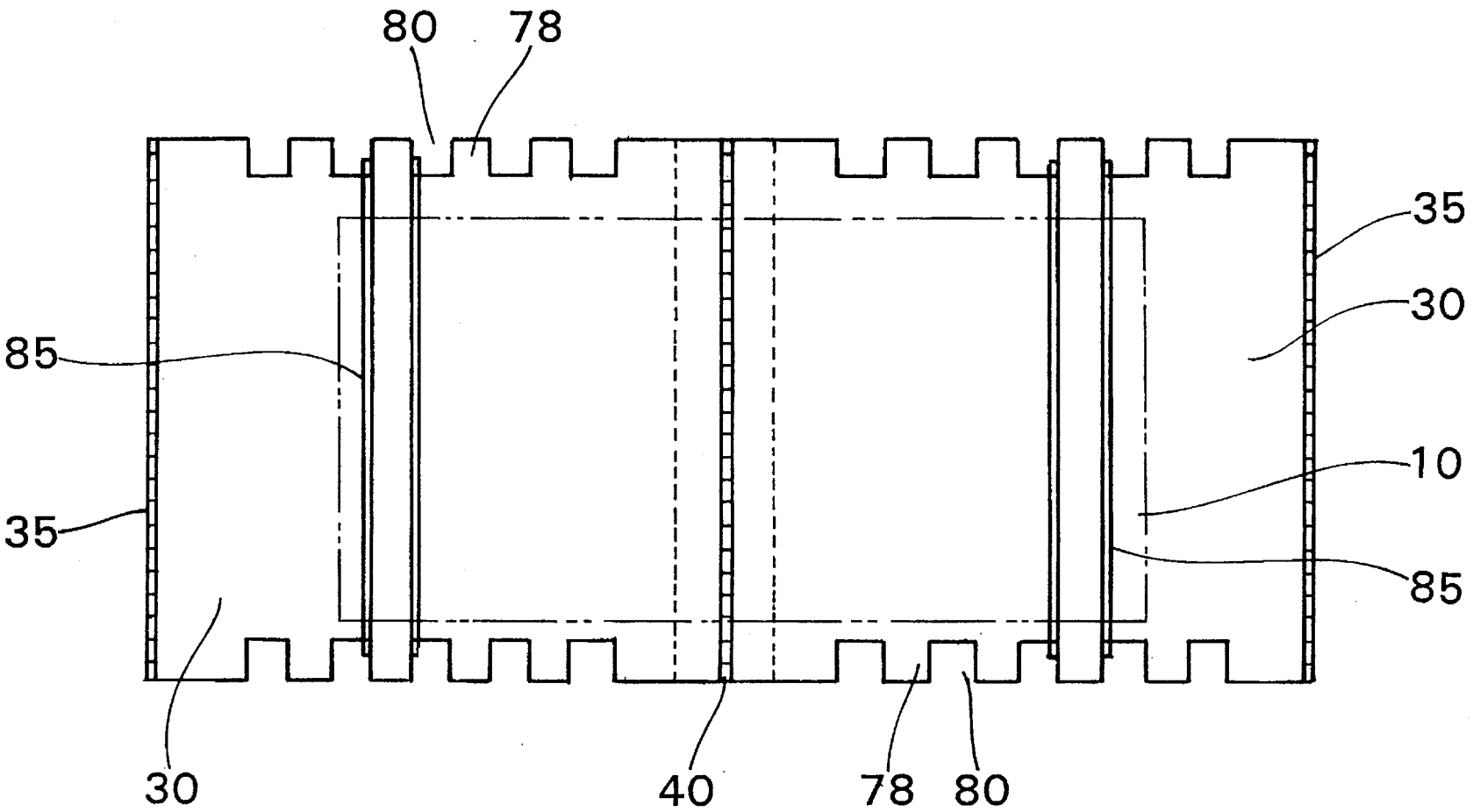
FIG. 8 is a top view of an alternative embodiment of the invention.

FIG. 8 discloses a second alternative page retaining means for the invention. The free edges of panels 30 are formed with a series of tabs 78 and recesses 80. After placing book 10 on the stand 20, a binder 85 is attached to the tabs 78 on either side of the panel 30. The binder 85 may be any known means such as rubber bands, elastic straps, bungee cord, or the like. The binder 85 traverses over book 10 to secure it to the book holding surface 33.

During use, the stand 20 is unfolded from its compacted travel state, as illustrated in FIG. 3. The panels 30 are placed into the peaked configuration, with the integral limiting means maintaining the panels 30 in position. The support members 25 are unfolded and maintained at the proper angle by the side motion integral limiting means. As a result, stand 20 is sufficiently sturdy to support books 10 thereon. After unfolding the stand 20 into the proper configuration for use, sand spikes 45 are forcibly inserted into the ground. The reader then places a book on the book holding surface 33, and retains the book in place by page retainers 46, 50 or elastic means 85. After book 10 has been secured on stand 20 reader places his/her head beneath the stand while lying in a supine position to read book 10. When desired, the stand 20 may be refolded into its compact state for travel.

While only particular embodiments of the present invention have been described and illustrated, it would be obvious to those skilled in the art that various other changes and modifications can be made without departing from spirit and scope of the present invention or claims below.

I claim:

1. An inverted book stand comprised of a book support platform having two transparent panels, each having an inner edge, an outer edge, a book support surface and a bottom surface, the panels are pivotally connected along the inner edges and can be moved from a first, stowed/transport position, where the panels are folded together and in close proximity to each other, to a second, in use position, where the panels are opened to form an angle of less than 180°;

integral limiting means at the pivotal connection between the panels to maintain the angle between panels when they are in the open position;

support members pivotally connected to the outer edge of each panel which can be moved from a first, stowed position, wherein each support member is in a closed position parallel and adjacent to the respective panel surface, and a second, in use position, where the support member is pivoted to an angle of more than 90° from the panel surface; and integral limiting means at the pivotal connection between each support member and the panels to limit the angle formed between them when the support members are opened whereby the book stand can be folded to a flat, compact size by folding the panels and the support members to the stowed positions.

2. The inverted book stand of claim 1 wherein the angle between the bottom panel surfaces when they are in the second, in use position is from about 140° to 150°.

3. The inverted book stand of claim 1 wherein the pivotal connection between the panels is a flexible plastic material.

4. The inverted book stand of claim 3 wherein the flexible plastic material is transparent.

5. The inverted book stand of claim 3 wherein the flexible plastic material is integrally formed with the panels.

6. The inverted book stand of claim 1 wherein the pivotal connection between the panels is a hinge.

7. The inverted book stand of claim 1 wherein the pivotal connection between the panels and the support member is a hinge.

8. The inverted book stand of claim 1 further comprising page retainers mounted on the panels.

9. The inverted book stand of claim 8 wherein the page retainers comprise spring clips mounted on the panels.

10. The inverted book stand of claim 1 wherein a plurality of tabs and recesses are formed along opposite free edge of each panel, and an elastic member is attached between the tabs to retain a book in position.

* * * * *

UNITED STATES PATENT AND TRADEMARK OFFICE

CERTIFICATE OF CORRECTION

PATENT NO. : 5,485,980

DATED : January 23, 1996

INVENTOR(S) : Paul Luccia

It is certified that error appears in the above-indentified patent and that said Letters Patent is hereby corrected as shown below:

Column 2, line 49, delete "ant" and insert —and—.
Column 3, line 25, after "edges" insert —31.—.
Column 3, line 36, after "edge" insert —31—.
Column 3, line 64, after "panels" insert —30—.
Column 4, line 25, after "about fastener 54" insert — . —.
Column 6, line 17, delete "panels" and insert —panel—.

Signed and Sealed this

First Day of October, 1996

Bruce Lehman

*Attest:*

BRUCE LEHMAN

*Attesting Officer*

*Commissioner of Patents and Trademarks*